US005125846A

United States Patent [19]

Sampson et al.

[11] Patent Number: 5,125,846

[45] Date of Patent: Jun. 30, 1992

[54] INPUT-OUTPUT ELECTRICAL CONNECTOR

[75] Inventors: Stephen A. Sampson, Downers Grove; Jerry A. Long, Elgin, both of Ill.

[73] Assignee: Molex Incorporated, Lisle, Ill.

[21] Appl. No.: 735,741

[22] Filed: Jul. 25, 1991

[51] Int. Cl.[5] ..... H01R 9/07; H01R 9/09

[52] U.S. Cl. ..... 439/66; 439/77; 439/170; 439/404; 439/925

[58] Field of Search ..... 439/67, 77, 68, 70, 439/71, 72, 73, 76, 166, 170–175, 404, 405, 492, 925, 525, 535, 66

[56] References Cited

U.S. PATENT DOCUMENTS 4,235,500 11/1980 Belopavlovich ..... 439/495
4,589,715 5/1986 Weisenburger ..... 439/77
4,932,873 6/1990 La Shier ..... 439/493

*Primary Examiner*—Neil Abrams
*Attorney, Agent, or Firm*—A. A. Tirva

[57] ABSTRACT

An electrical connector is provided for electrically coupling a plurality of conductors of different configuration with an electronic component. A plurality of insulation displacement terminals and a plurality of surface terminating terminals are provided for use with the connector assembly. A common housing mounts the electronic component and has channels for locating a plurality of discrete insulated conductor wires and a surface area for interfacing with a substrate having a plurality of surface conductors thereon. The housing includes a plurality of first receptacles for selectively receiving the insulation displacement terminals for termination to the insulated conductor wires and electrically coupling the wires to the electronic component, and a plurality of second receptacles for, alternatively, receiving the surface terminating terminals in termination with the conductors on the substrate and electrically coupling the conductors to the electronic component. Therefore, the common housing, in combination with either the insulation displacement terminals or the surface terminating terminals, can be used to electrically couple either discrete insulated conductor wires or surface conductors, respectively, to the electronic component.

13 Claims, 4 Drawing Sheets

INPUT-OUTPUT ELECTRICAL CONNECTOR

FIELD OF THE INVENTION

This invention generally relates to the art of electrical connectors and, particularly, to an input-output electrical connector for electrically coupling a plurality of conductors with an electronic component or device.

BACKGROUND OF THE INVENTION

There are many applications in the electronic industry, such as in copying machines, computers and the like, wherein a plurality of conductors must be terminated to various electronic components to carry out various functions of a machine or apparatus. For instance, in a copying machine, control electronics are fed through data conductors or lines and power conductors or lines to various devices, such as motors, audible or visual indicators, or the like which perform the various functions of the machine, such as changing the reduction of the copying process, varying the numbers of copies, rendering audible or visual signals, and the like. Electronic components or devices, such as printed circuit boards, integrated circuit chips, headers or connectors must be coupled through electrical connectors to the power and data transmission conductors or lines.

One of the problems with electronic systems of the character described is that the power and data conductors may take various forms, such as discrete insulated wire conductors, ribbon cable conductors, inlaid conductors and the like. Consequently, different configurations of input-output electrical connectors must be used to coupled the different power and data conductors to the various electronic components of the machine or apparatus. In any instance where different or specialized electrical connectors must be provided, the cost of the machine increases, particularly where a considerable number of electrical connectors are used in the system. It would be desirable to provide an electrical connector assembly, including a common or universal housing which can accommodate different types of terminals for terminating and coupling different types of conductors to the electronic components associated with the connector. This invention is directed to solving the above problems and satisfying the stated need.

SUMMARY OF THE INVENTION

An object, therefore, of the invention is to provide a new and improved input-output electrical connector for electrically coupling a plurality of conductors of different configurations with an electronic component or components.

In the exemplary embodiment of the invention, the electrical connector includes a common housing having mounting means for mounting the electronic component(s) thereon. Locating means are provided on the housing for locating a plurality of discrete insulated conductor wires. Interfacing means are provided on the housing for interfacing with a substrate having a plurality of surface conductors thereon. The common housing includes a plurality of first receptacle means and a plurality of second receptacle means. The first receptacle means receive a plurality of wire insulation displacement terminals for termination to the discrete insulated conductor wires and electrically coupling the wires to the electronic component. The second receptacle means receive a plurality of surface terminating terminals for termination to the conductors on the substrate and electrically coupling the conductors to the electronic component. Therefore, the common housing, in combination with either the insulation displacement terminals or the surface terminating terminals, can be used to electrically couple either discrete insulated conductor wires or surface conductors to the electronic component.

The invention contemplates an electrical connector assembly including the common housing described above in combination with a plurality of the insulation displacement terminals and a plurality of the surface terminating terminals. The particular configuration of terminals are selectively mounted in the common housing depending upon the configuration of conductors which must be coupled to the electronic component.

As disclosed herein, the electronic component is shown in the form of a printed circuit board having an integrated circuit chip and various header connectors thereon. The insulation displacement terminals each have a wire insulation displacement portion at one end and a surface mounting portion at an opposite end for electrically coupling the discrete insulated conductor wires to circuit traces on &:he printed circuit board. The surface terminating terminals each have surface mounting portions at opposite ends for electrically coupling the conductors on the substrate to circuit traces on the printed circuit board.

The common housing is configured to have a pocket in the top thereof for receiving the printed circuit board, along with the integrated circuit chip and header connectors on the board. The locating means for the discrete insulated conductor wires and the interfacing means for the surface conductors on the substrate are provided on the bottom of the housing. Particularly, the locating means are provided in the form of channels in the bottom of the housing for receiving the discrete insulated conductor wires, and the bottom of the housing has surface means for engaging the substrate with means on the housing for attachment to the substrate.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
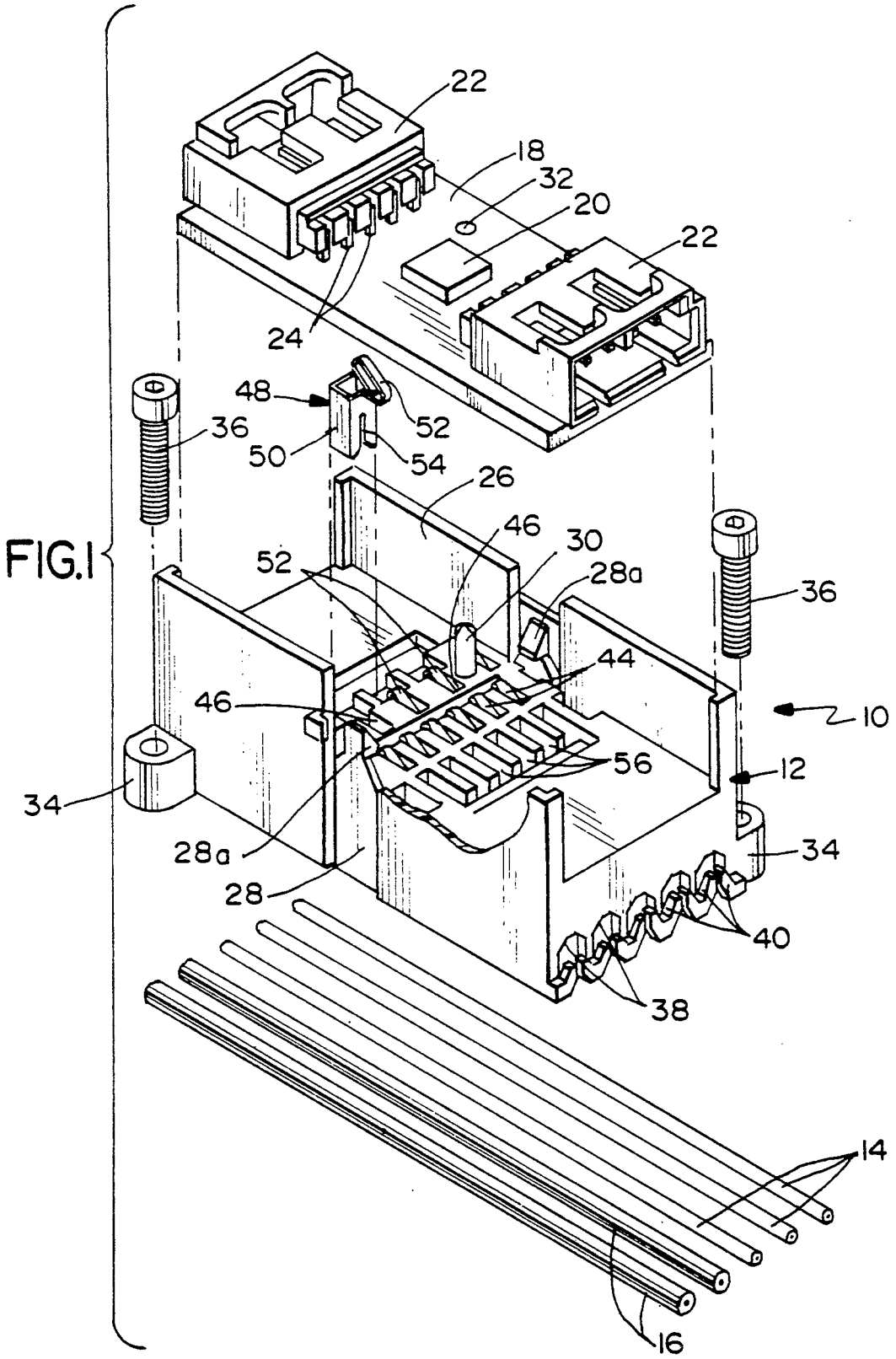
FIG. 1 is an exploded perspective view, of an electrical connector assembly for terminating a plurality of discrete insulated conductor wires and embodying the concepts of the invention.

Referring to the drawings in greater detail, and first to FIG. 1, an electrical connector assembly, generally designated 10, is shown to include a common housing, generally designated 12. The electrical connector assembly is an input-output connector for coupling a plurality of conductors of different configurations with an electronic component. As illustrated in FIG. 1, the conductors are conventional discrete insulated conductor wires, including three data transmission wires 14 and two power transmission wires 16. The electronic component is shown in the form of a conventional printed circuit board 18 having circuit traces thereon. An integrated circuit chip 20 is mounted on top of the printed circuit board, and a pair of header connectors 22, having terminal pins 24, are mounted on top of the printed circuit board. The housing mounts terminals for coupling data and power transmission lines 14 and 16, respectively, to the circuit traces on printed circuit board 18.

The connector assembly described above can be used for distributing power and data through any electrical apparatus requiring such distribution. Control electronics from a control station run through the machine in data and power transmission lines 14 and 16, respectively. The connector terminates the lines to circuit traces on printed circuit board 18, and integrated circuit chip 20 distributes the power and data to various devices in the machine through header connectors 22 which receive complementary connectors (not shown) electrically coupled to the various devices such as motors, audible and visual indicating means, and the like. For instance, the control electronics may include an actuator to change the degree of reduction of the copying machine from an original copy sheet. The electronic chip will tell a motor on the machine its respective function, through one of the header connectors 22, through a complementary connector leading to the particular motor.

Figure 2:
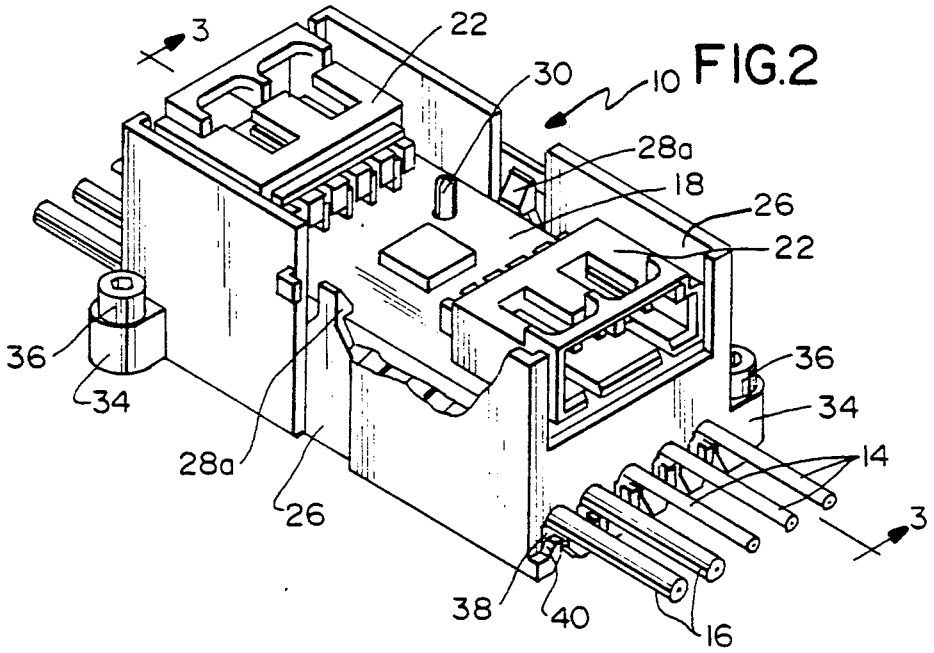
FIG. 2 is a perspective view of the electrical connector assembly of FIG. 1 in assembled condition terminating the insulated conductor wires.

More specifically, common housing 12 is recessed in the top thereof to define a pocket 26 for receiving printed circuit board 18. The printed circuit board is shown in FIG. 2 disposed within the pocket. The housing is integrally molded of plastic material, such as glass filled polyester, and includes a pair of integrally molded latch arms 28 having hook portions 28*a* whereby the hook portions snap over the top of printed circuit board 18 when fully seated in the housing as shown in FIG. 2. The housing may have an upwardly protruding polarizing pin 30 for insertion through a polarizing hole 32 in the printed circuit board. The housing also has a pair of outwardly protruding bosses 34 through which a pair of screws or bolts 36 can be inserted to securely mount the housing to a frame of the machine (not shown).

Integrally molded housing 12 has locating means in the form of a plurality of channels 38 for locating discrete insulated conductor wires 14 and 16. The channels are partially closed by retention fingers 40 whereby the conductors or wires are retained in the channels by snapping the conductors past the retention fingers.

Figure 3:
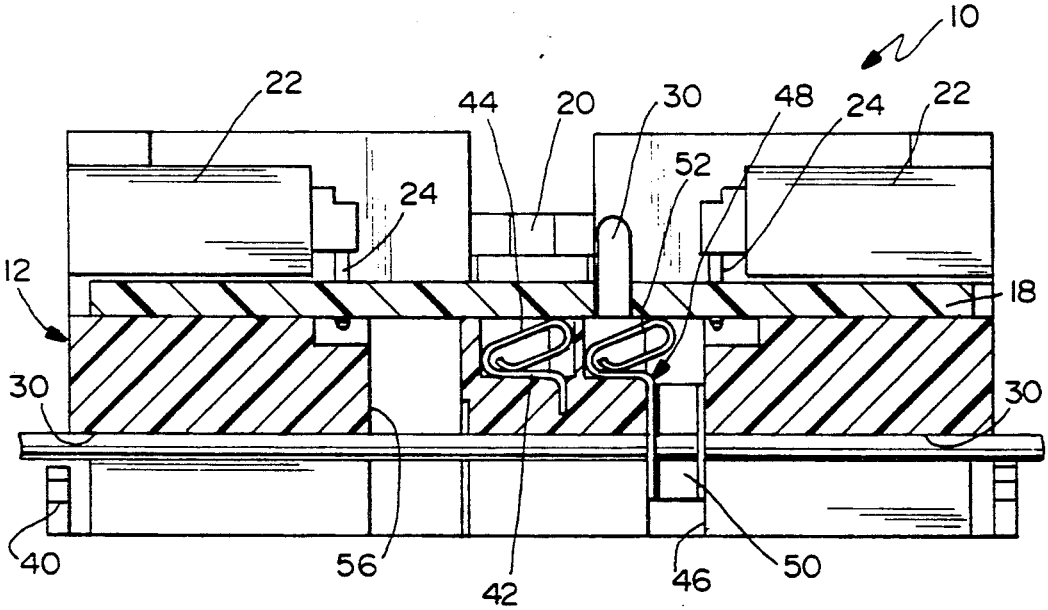
FIG. 3 is a vertical section taken generally along line 3—3 of FIG. 2.

Referring to FIG. 3 in conjunction with FIG. 1, in the particular application of electrical assembly 10 described herein, a programming strip 42 is mounted in housing 12, with a plurality of upwardly projecting, cantilevered contact portions 44. As stated above, the electrical connector is designed to couple data transmission lines or conductors 14 to printed circuit board 18. Conventional circuit traces on the printed circuit board interconnect with integrated circuit chip 20. Programming strip 42,44 is provided to program the integrated circuit chip to whatever electronic configuration is in the machine. The strip is programmed by selectively bending one or more of cantilevered contact portions 44 downwardly so that they do not engage particular circuit traces on the underside of the printed circuit board. In essence, the programming strip tells the integrated circuit chip to perform various electronic functions by selectively shorting out circuit traces on the printed circuit board. In this manner, a generic integrated circuit chip can be provided and simply programmed within the assembly.

Still referring to FIG. 3 in conjunction with FIG. 1, common housing 12 includes a plurality of first receptacle means in the form of through passages 46 for receiving a plurality of wire insulation displacement terminals, generally designated 48, which are press-fit into the passages. In the embodiment illustrated, five passages 46 are provided for five terminals 48 corresponding to the five data and power transmission conductors or lines 14 and 16, respectively. Of course, it should be understood that this number is for illustration purposes only.

Each wire insulation displacement terminal 48 includes a wire insulation displacement portion 50 and a surface mounting or engagement portion 52. The wire insulation displacement portion 50 includes a slot 54 for piercing the insulation about a respective one of the discrete conductors to establish conductivity with the conductor wire therewithin, as seen in FIG. 3. Surface mounting portion 52 projects upwardly for engagement with an appropriate circuit trace on printed circuit board 18, also as shown in FIG. 3.

As stated above, the invention contemplates that electrical connector assembly 10 is provided for electrically coupling a plurality of conductors of different configurations with an electronic component, such as integrated circuit board 18. To this end, and referring to FIG. 4 in conjunction with FIG. 1, common housing 12 includes a plurality of second receptacle means in the form of through passages 56 for receiving a plurality of surface terminating terminals, generally designated 58.

More particularly, each surface terminating terminal 18 includes an upper surface mounting or engaging portion 60, similar to portion 52 of insulation displacement terminal 48, for engaging an appropriate circuit trace on printed circuit board 18. However, the bottom of each terminal 58 is provided with another surface mounting or engaging portion 62 for electrical interconnection with a surface conductor 64 on a substrate 66. For instance, surface conductor 64 may be a circuit trace on a second printed circuit board, or, as described hereinafter, the surface conductor may be on or inlaid within a frame portion of the machine.

Figure 4:
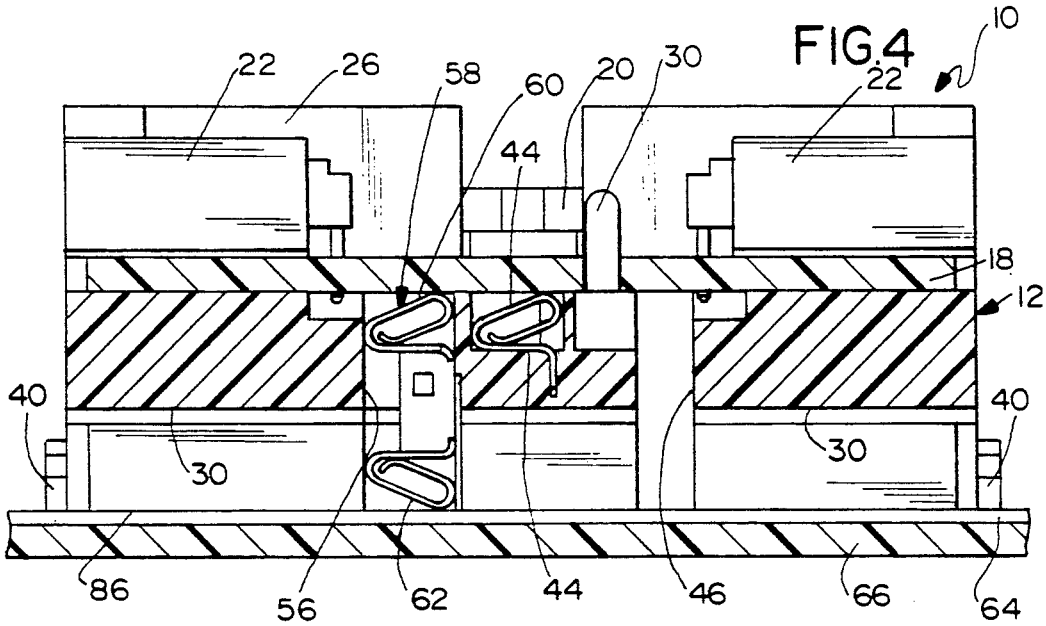
FIG. 4 is a vertical section similar to that of FIG. 3 but with the electrical connector assembly including terminals for surface terminating a plurality of conductors on a substrate.

As seen in FIGS. 3 and 4, all of surface mounting or engaging portions 52 of terminals 48 and 60,62 of terminals 58 are fabricated as oblong spring portions of the terminals to maintain surface engagement with the respective circuit traces or conductors. Surface terminating terminals 58 are forced into passages 56 and the end spring portions facilitate maintaining the terminals in the passages. Terminals 58 are allowed to float within the passages 56 to take-up tolerance stack-up.

From the foregoing, and particularly comparing FIGS. 3 and 4, it can be seen that common housing 12 is configured for selectively receiving either insulation displacement terminals 48 or surface terminating terminals 58 depending upon the particular configuration of conductors for coupling to printed circuit board 18. Therefore, the illustrated embodiment of the invention can accommodate either discrete insulated conductors 14 and 16 or surface mounted conductors 64.

Figure 6:
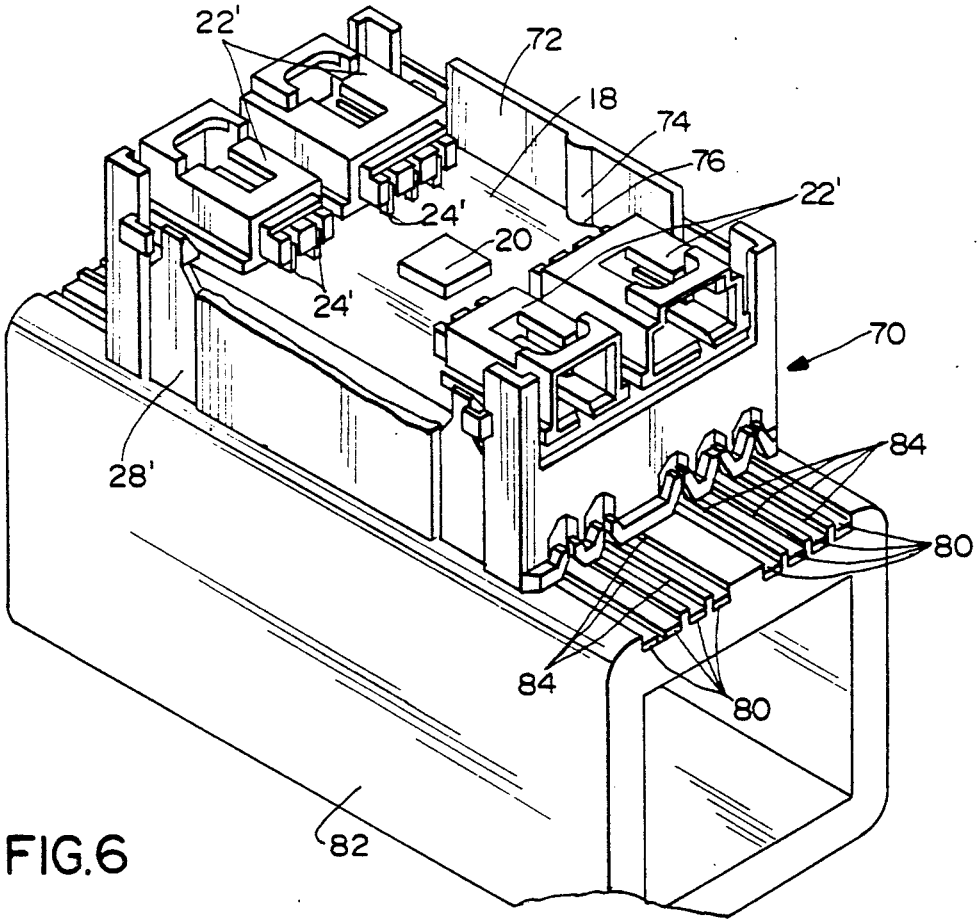
FIG. 6 is a perspective view of the electrical connector assembly of FIG. 5 in assembled condition and terminated to the frame having the surface or inlaid conductors thereon.
Figure 5:
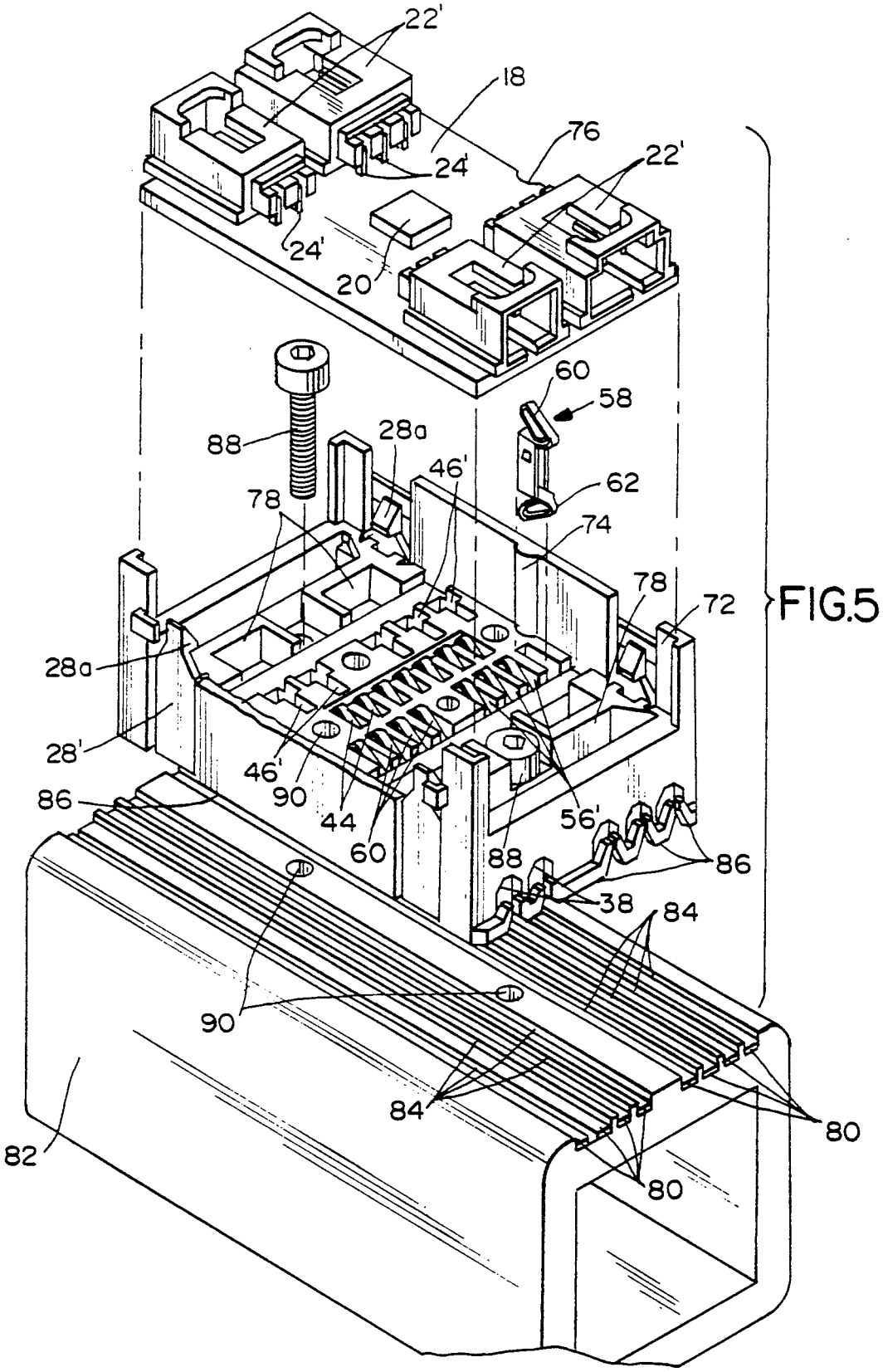
FIG. 5 is an exploded perspective view of an alternate form of electrical connector assembly embodying the concepts of the invention, in conjunction with a frame having surface and inlaid conductors thereon.

FIGS. 5 and 6 show an alternate form of the invention wherein a common housing, generally designated 70, is of a somewhat different configuration, but still incorporates the concepts of the invention. Again, the housing is recessed in the top thereof to define a pocket 72 for receiving printed circuit board 18, along with integrated circuit chip 20, but four header connectors 22', along with terminal pins 24', are mounted on the printed circuit board. Again, spring latch arms 28', having hook portions **28*a'*, are integrally molded with the housing for securely holding the printed circuit board in pocket 72. In this embodiment, polarization means is provided by a rib 74 molded integrally with the housing, on the inside of pocket 72, for seating in a notch 76 cut into one side of printed circuit board 18. Again, a programming strip is provided with cantilevered contact portions 44 as described in relation to FIGS. 1 and 3. Although not utilized in the illustration of FIGS. 5 and 6, common housing 70 again has a plurality of first receptacle means or through passages 46' for receiving insulation displacement terminals 48, as well as channels 38 for receiving discrete insulated conductor wires 14 and 16. Housing 70 has a plurality of open areas 78** which simply are material coreout areas during the molding process.

In the application of electrical connector assembly 70, a plurality of surface terminating terminals 58 having surface mounting or engaging portions 60 are received within second receptacle means or passages 56' just as was described in relation to FIG. 4. In other words, either configuration of common housing 12 (FIG. 1) or common housing 70 (FIG. 5) incorporates the concepts of the invention wherein different configurations of terminals can be selectively mounted in the housing to couple different configurations of conductors to an electronic component, such as printed circuit board 18.

In the illustration of FIGS. 5 and 6, a plurality of surface mounted conductors 80 are provided on a frame 82. As illustrated, the conductors actually are inlaid within grooves 84 on the top of the frame. Therefore, surface engaging portions 62 of terminals 58 engage conductors 80 within grooves 84, similar to the depiction of FIG. 4. Frame 82 may be a frame portion of the machine with which the electrical connector assembly is utilized. Housing 70 is interfaced with frame 82 by seating a bottom surface area 86 on top of the frame. The housing is secured to the frame by screws or bolts 88 threaded into holes 90 in the frame.

As stated above, the numbers of terminals 48 or 58 (along with the numbers of receptacle means or passages in the common housings) can vary with the particular application of the connector assembly. To that end, common housing 70 is shown with eight passages 56' for receiving eight terminals 58 which are engageable with eight surface mounted or inlaid conductors 80, as illustrated. In addition, it should be understood that either common housing 12 or 70 may be provided with more through passages and terminals than might be used in a particular application in order to expand the use of the connector assembly. For instance, rather than there being eight conductors 80 in a given application, there might be only five conductors. Therefore, only five terminals 58 would be assembled in a selected five passages 56' for surface engaging the five conductors, all depending upon the particular electronic system of a given machine. The same is true of the five insulation displacement terminals 48.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for electrically coupling a plurality of conductors of different configurations with an electronic component, a common housing comprising mounting means for removably mounting the electronic component thereon, locating means for locating a plurality of discrete insulated conductor wires on the housing, interfacing means for interfacing the housing with a substrate having a plurality of surface conductors thereon, a plurality of first receptacle means in the housing for receiving a plurality of wire insulation displacement terminals for termination to the discrete insulated conductor wires and electrically coupling the wires to the electronic component, and a plurality of second receptacle means in the housing for receiving a plurality of surface terminating terminals for termination to the conductors on the substrate and electrically coupling the conductors to the electronic component, whereby the common housing, in combination with either the insulation displacement terminals or the surface terminating terminals, can be used to electrically couple either discrete insulated conductor wires or surface conductors, respectively, to the electronic component.

2. In an electrical connector as set forth in claim 1, wherein said mounting means are disposed on one side of the housing and said locating means and interfacing means are disposed on another side of the housing, and said first and second receptacle means comprise through passages in the housing between said sides.

3. In an electrical connector as set forth in claim 1, including a plurality of said insulation displacement terminals each having a wire insulation displacement portion at one end and a surface mounting portion at an opposite end for electrically coupling the discrete insulated conductor wires to a printed circuit board.

4. In an electrical connector as set forth in claim 1, including a plurality of said surface terminating terminals each having surface mounting portions at opposite ends for electrically coupling the conductors on the substrate to a printed circuit board.

5. In an electrical connector as set forth in claim 4, including a plurality of said insulation displacement terminals each having a wire insulation displacement portion at one end and a surface mounting portion at an opposite end for electrically coupling the discrete insulated conductor wires to a printed circuit board.

6. In an electrical connector as set forth in claim 1, wherein said locating means include channel means disposed in the bottom of the housing, and said mounting means include a pocket in the top of the housing for removably receiving an electronic component such as a printed circuit board and the like.

7. In an electrical connector as set forth in claim 1, wherein said interfacing means are disposed on the bottom of the housing, and including a pocket in the top of the housing for receiving an electronic component such as a printed circuit board and the like.

8. In an electrical connector as set forth in claim 1, wherein said interfacing means include a bottom surface area of the housing for seating on the substrate, and said locating means include channel means in said surface area.

9. In an electrical connector as set forth in claim 8, wherein said mounting means include a pocket in the top of the housing for removably receiving an electronic component such as a printed circuit board and the like.

10. An electrical connector assembly for electrically coupling a plurality of conductors of different configurations with an electronic component, comprising:

a plurality of wire insulation displacement terminals;

a plurality of surface terminating terminals; and a common housing including mounting means for removably mounting the electronic component thereon, locating means for selectively interfacing the housing with a substrate having a plurality of surface conductors thereon, a plurality of first receptacle means in the housing for receiving the plurality of wire insulation displacement terminals for termination to the insulated conductor wires and electrically coupling the wires to the electronic component, and a plurality of second receptacle means in the housing for receiving a plurality of the surface terminating terminals for termination to the conductors on the substrate and electrically coupling the conductors to the electronic component, whereby the common housing, in combination with either the insulation displacement terminals or the surface terminating terminals, can be used to electrically couple either discrete insulated conductor wires or surface conductors, respectively, to the electronic component.

11. The electrical connector assembly of claim 10, wherein said interfacing means include an outside surface area of the housing and said locating means include channel means in said surface area.

12. The electrical connector assembly of claim 11, wherein said mounting means include a recessed area of the housing on a side thereof opposite said surface area.

13. The electrical connector assembly of claim 12, wherein said recessed area comprises a pocket for removably receiving an electronic component such as a printed circuit board and the like.

* * * * *